US007160419B2

(12) United States Patent
Suzuki et al.

(10) Patent No.: US 7,160,419 B2
(45) Date of Patent: Jan. 9, 2007

(54) COATED PAPER FOR PRINTING

(75) Inventors: Masahito Suzuki, Tokyo (JP); Koji Okomori, Tokyo (JP); Masato Yamaguchi, Tokyo (JP); Hirokazu Morii, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 163 days.

(21) Appl. No.: 10/402,108

(22) Filed: Mar. 27, 2003

(65) Prior Publication Data

US 2004/0261963 A1 Dec. 30, 2004

(30) Foreign Application Priority Data

Mar. 29, 2002 (JP) ..... 2002-098069

(51) Int. Cl.
*D21F 11/00* (2006.01)

(52) U.S. Cl. ..... 162/135; 162/158; 162/181.4; 162/164.1; 428/342

(58) Field of Classification Search ..... 162/135, 162/158, 164.1, 181.4, 136; 428/342; 427/361, 427/365

See application file for complete search history.

(56) References Cited

U.S. PATENT DOCUMENTS 6,531,183 B1 * 3/2003 Cason et al. ..... 427/361

FOREIGN PATENT DOCUMENTS

JP 2000-345493 12/2000
JP 2000-345493 A * 12/2000

OTHER PUBLICATIONS

Handbook For Pulp and Paper Technologies, Gary Smook, 1992, pp. 339-340.*

* cited by examiner

*Primary Examiner*—Mark Halpern
(74) *Attorney, Agent, or Firm*—Knobbe, Martens Olson & Bear LLP

(57) ABSTRACT

A coated paper for printing comprising a base paper and a coating layer containing a pigment and an adhesive, wherein the coating layer has a volume distribution of 65% or more of pigment particles ranging from 0.4 μm to 4.2 μm in size, and wherein the coated paper has a basis weight of 50 μg/m$^2$ or less and tensile stiffness ranging between 200 kN/m and 400 kN/m, inclusive.

4 Claims, No Drawings

COATED PAPER FOR PRINTING

This application claims priority to Japanese Patent Application No. 2002-098069, filed Mar. 29, 2002, under 35 U.S.C. § 119(a).

BACKGROUND OF THE INVENTION

1. Field of the Invention

This invention relates to a coated paper for printing that is light in weight yet offers particularly excellent appearance in the unprinted state along with equally excellent printability.

2. Description of the Related Art

There has been a strong demand of late for high-quality, coated papers for printing suitable for printed matter containing many photographs, illustrations and colors, given the desire to convey the printed content with strong visual impact. On the other hand, there is also a strong demand to reduce the weight of printed matter as a means of saving energy and the costs of shipping and mailing. These two basic demands are mutually exclusive, however, since high-quality, coated papers for printing use a heavier base paper and more coating material and are more expensive, thus failing to meet the need for light weight and low cost. This has given rise to a need for technology that achieves higher printing quality using a so-called "low-grade" coated paper having low basis weight and coating weight.

Whiteness, opacity, sheet gloss, printed gloss and stiffness are particularly important among the qualities required of a coated paper. Whiteness enhances contrast, while opacity prevents the content on the back face of the printed page from showing through. Gloss affects the quality feel of the printed matter. It is essential that all these properties be satisfied while maintaining an optimal balance. Stiffness mainly affects printing efficiency and is an important factor that determines the ease with which the printed pages can be turned.

Coated papers are largely classified into glossy coated papers and matte-coated papers. Glossy coated papers include art papers and high-grade art papers used in the printing of expensive publications, and other coated papers used for printing catalogues, magazines, brochures, and so on. These papers, with their glossy finish, offer excellent gloss in both the unprinted and printed areas of the finished product. Matte-coated papers include those of dull finish and matte finish and offer lower gloss in both unprinted and printed areas. Matte finish makes the printed product look flat and heavy due to its low gloss. Dull finish has a property intermediate between glossy and matte finish, as it offers low sheet gloss but high printed gloss.

As mentioned above, reducing the weight of a coated paper for printing requires a reduction in the basis weight of the base paper and a reduction in the weight of the coating layer. However, simply reducing the basis weight without changing the composition of the paper material will reduce the paper thickness in proportion to the decrease in the weight of the paper, resulting in insufficient opacity and stiffness. Providing a thick coating layer on a base paper of low basis weight will retain the same level of printability achieved with-a base paper of normal basis weight, but this approach is not practical because the opacity and stiffness will drop. Additionally, such a measure will reduce the tensile stiffness, possibly leading to problems during offset web printing such as torn paper on the turning cylinder, at the paster, or when the press is started.

Providing a coating layer with low coating weight on a base paper of high basis weight achieves sufficient opacity and stiffness. However, reducing the basis weight of a coated paper through this method will require a substantial reduction in the coating weight, in fact to a degree below what is necessary. That results in insufficient printing quality, so therefore the approach is impractical. In other words, a certain balance must be maintained between basis weight and coating weight, requiring a combination of low-basis-weight base paper with a coating layer with low coating weight, or a high-basis-weight base paper with a coating layer with high coating weight. Generally, papers with lower basis weight offer lower whiteness, opacity, sheet gloss, printed gloss and stiffness compared with those of higher basis weight.

Generally speaking, opacity drops dramatically when the basis weight becomes 80 g/m$^2$ or less. To minimize the drop in stiffness and opacity while reducing the basis weight to a certain extent, a lower-density, higher-bulk paper should be produced. Such paper can be made effectively using mechanical pulp from certain types of trees such as gum-wood, maple and birch. However, limiting the types of usable trees is not practical from the viewpoints of energy and economy. At any rate the use of mechanical pulp, regardless of the source trees, helps increase stiffness and opacity. Methods known to reduce basis weight and improve opacity include the addition of hollow synthetic resin capsules (Japanese Patent Publication No. 52-118116), and the addition of a synthetic organic foaming filler (such as EXPANSEL by Nippon Filant) and causing the filler to foam in the drying stage. However, hollow synthetic resin capsules and foaming fillers require a complex process of adjusting the mixing and foaming conditions, and they are also expensive. Therefore, these are not presently seen as practical methods. Instead of using a filler, Japanese Patent Application Laid-open No. 8-13380 proposes a method to add micro-fibril cellulose. However, this method is also impractical, because it requires that micro-fibril cellulose be prepared separately, thus complicating the operation. It is known that the addition of fillers, particularly titanium dioxide, to the base paper increases opacity. However, it increases density while reducing stiffness and paper strength. These factors prevent us from simply adding fillers.

As explained above, the simple application of the prior art will not provide a lightweight coated paper for printing that possesses the desired characteristics.

SUMMARY OF THE INVENTION

Given the aforementioned situation, the present invention aims to provide a coated paper for printing that is light in weight yet offers opacity suitable for actual use, possessing a relatively good ink-impression property and high printed gloss, and particularly an excellent printability that prevents the paper from tearing during offset web printing.

The inventors have carried out extensive studies to find ways to solve the above problems, and have found that a coated paper for printing consisting of a base paper and a coating layer containing pigment and adhesive will be light in weight yet offer opacity suitable for actual use, possessing a relatively good ink-impression property and high printed gloss, and particularly an excellent printability that prevents the paper from tearing during offset web printing, if said coating layer has a volume distribution of 65% or more of pigment particles ranging from 0.4 μm to 4.2 μm in size, and also if said coated paper has a basis weight of 50 g/m$^2$ or less and tensile stiffness between 200 kN/m and 400 kN/m, inclusive. Such paper would therefore solve the above problems. This finding has led to the invention presented here.

DETAILED DESCRIPTION OF THE PREFERRED EMBODIMENT

In the present invention it is important to use a pigment whose particle size is between 0.4 μm and 4.2 μm for at least 65% of the total pigment volume. The percentage of pigment particles ranging between 0.4 μm and 4.2 μm is preferably from 65% to 90%.

If a pigment is used that contains many particles of smaller diameter and where the percentage of pigment particles ranging between 0.4 μm and 4.2 μm is less than 65% of the total pigment volume, sheet gloss will increase but printed gloss and coatability of the base paper will decease relative to the use of a pigment containing many particles of larger diameter. Therefore, if a pigment containing many particles of smaller diameter is used to reduce the coating weight, it is difficult to produce a coated paper for printing offering excellent appearance in the unprinted state along with equally excellent printability, even though the basis weight of the base paper is increased. Further, if a pigment is used that contains many particles of larger diameter and where the percentage of pigment particles between 0.4 μm and 4.2 μm is less than 65% of the total pigment volume, the printed gloss and coatability of the base paper will improve but sheet gloss will become insufficient by comparison to the use of a pigment containing many particles of smaller diameter. These facts still point to the difficulty of producing a coated paper for printing that offers excellent appearance in the unprinted state along with equally excellent printability.

Any type of pigment can be used in the present invention, as long as the aforementioned volume-distribution range is satisfied. The available pigments include those traditionally used in the production of coated papers, such as kaoline, clay, delaminated clay, ground calcium carbonate, precipitated calcium carbonate, talc, titanium dioxide, barium sulfate, calcium sulfate, zinc oxide, silicic acid, silicate, colloidal silica, satin white and other inorganic pigments. These pigments can be used alone or in any of various combinations. In the present invention it is preferable to use a combination of multiple pigments to achieve the desired properties such as the coatability and quality of the coated paper. However, in this case it is important that the particle size distribution of the overall pigment have at least 65% of all pigment particles in a range of 0.4 μm to 4.2 μm. The pigments to be used in the present invention are required to have a certain characteristic in their particle size distribution; namely, they must have particles of relatively larger size than those in normal coating pigments, thereby accounting for a larger percentage of the overall pigment. Pigments that already have a desired particle size distribution may be selected, or a pigment mixture with the specified particle size range may be created via classification. This way, the coatability of the base paper's surface can be increased even at a low coating weight, thereby achieving a relatively high degree of printed gloss.

In particular, it is preferable that 60 weight parts or more of kaolin having the particle size distribution of 65% or more in a range of 0.4 μm to 4.2 μm, is used relative to 100 weight parts of pigment.

The present invention improves the sheet gloss and other properties of a coated paper for printing, provided that said paper contains between 1 and 20 weight-parts, inclusive, (preferably from 3 to 15 weight-parts), of hollow plastic pigment with a diameter of 0.8 μm or more (preferably from 0.8 μm to 1.5 μm) relative to 100 weight-parts of pigment. Hollow plastic pigment with a particle diameter of less than 0.8 μm will not achieve good coatability at low coating weight. Moreover, the bulk of the coating layer does not increase and sufficient opacity cannot be obtained.

The present invention also relates to a coated paper with a basis weight of 50 g/m$^2$ or less, preferably 48 g/m$^2$ or less, or better yet 45 g/m$^2$ or less. If the basis weight of the coated paper is over 50 g/m$^2$, the sufficient basis weight and coating weight of the base paper will achieve a level of opacity required in actual use. Further, there won't be a problem regarding ink-impression property, printed gloss or other printability characteristics. In the present invention, however, it is preferable that between 0.5 and 12 wt-%, inclusive, (preferably from 1 to 9 wt-%), of titanium dioxide be added to the coated paper to obtain sufficient opacity even at a low basis weight of 50 g/m$^2$ or less. Titanium dioxide can be added to the base paper, coating layer, or both.

Additionally, in the present invention it is important to set the tensile stiffness of the paper thus obtained to a level ranging from 200 kN/m to 400 kN/m, inclusive, (preferably from 300 kN/m to 400 kN/m), as measured on a tensile tester by Lorentzen and Wettre, in order to prevent the paper from tearing during offset web printing. If the tensile stiffness exceeds 400 kN/m, a coated paper with a basis weight of 50 g/m$^2$ or less cannot absorb all the tension applied to the paper during offset web printing, and as a result it will tear easily. On the other hand, a tensile stiffness below 200 kN/m causes the coated paper to stretch easily, which makes positioning difficult during multicolor printing on an offset web press. Tensile stiffness can be adjusted by changing the conditions for making the base paper such as the J/W ratio, the content of added filler and dewatering level, the coating weight, and other conditions as necessary.

The various pulp materials that can be used to make the base-paper mixture of the present invention include chemical pulp (bleached or unbleached kraft pulp from softwood, bleached or unbleached kraft pulp from hardwood, etc.), mechanical pulp (groundwood pulp, thermomechanical pulp, chemi-thermomechanical pulp, etc.) and deinking (recycled) pulp, which may be used alone or in combination at arbitrary blending ratios. In the present invention the content of mechanical pulp should ideally be 20% or more to improve opacity. The types of fillers that may be added to the base paper include hydrated silicic acid, white carbon, talc, kaoline, clay, calcium carbonate, synthetic resin fillers and other known fillers. Besides the aforementioned pulps and fillers, aluminum sulfate, sizing agent, paper strength enhancer, retention-aiding agent, coloring agent, dye, defoaming agent and so on may be added as necessary. The content of fillers is preferably from 3 to 15 wt-%, more preferably from 6 to 12 wt-%, per total weight of the base paper.

The adhesives that may be used in the present invention include those traditionally used in the production of coated papers. They include various copolymers such as styrene-butadiene, styrene-acryl, ethylene-vinyl acetate, butadiene-methyl methacrylate and vinyl acetate-butyl acrylate; synthetic adhesives such as polyvinyl alcohol, maleic anhydride copolymer and acrylate-methyl methacrylate copolymer; proteins such as casein, soybean protein and synthetic protein; starches such as oxidized starch, cationic starch, urea phosphate esterified starch, hydroxyethyl etherified starch or other etherified starch, and dextrin; and cellulose derivatives such as carboxymethyl cellulose, hydroxymethyl cellulose and hydroxyethyl cellulose. One or more types of normal adhesives used for coated paper will be selected and used. These adhesives should be added roughly between 5 and 50 weight-parts, or better yet between 10 and 30 weight-parts, per 100 weight-parts of pigment.

The coating mixture used in the present invention may contain dispersant, thickener, water-retention agent, defoaming agent, waterproofing agent and various other additives regularly mixed into the coating materials.

The base paper used in the present invention may be made in an arbitrary manner on a Fourdrinier paper machine equipped with top wire, etc., a cylinder paper machine, a board machine combining the aforementioned two, a Yankee dryer machine, and so on, using the acid, neutral or alkali paper method. The base paper thus obtained may also be pre-coated with starch, polyvinyl alcohol or other material using a size press, bill blade, gate-roll coater or premetering sizing press, or it can be pre-coated with one or more layers of coating mixture containing pigment and adhesive.

The prepared coating mixture is applied to both sides of the base paper, either one side at a time or simultaneously on two sides, in one, two or more layers using a blade coater, bar coater, roll coater, air-knife coater, reverse roll coater, curtain coater, size-press coater, gate-roll coater, and so on. The ideal coating weight is between 2 and 15 g/m$^2$, or better yet 3 and 10 g/m$^2$, per side of the base paper.

The wet coating layer may be dried in a steam-heated cylinder, hot-air heater/dryer, gas heater/dryer, electric heater/dryer, infrared heater/dryer or high-frequency heater/dryer, which may be used alone or in combination.

The coated and dried paper is then smoothed in a process not using calendering, or it is treated through a process such as super-calendering or high-humidity soft-nip calendering.

EXAMPLES

The following is a detailed explanation of the present invention using examples. Of course, the invention is not limited to the examples provided. Unless otherwise specified, "part(s)" and "%" in the examples indicate weight-part(s) and wt-%, respectively. The coated papers obtained in the examples were tested through the following evaluation method:

<Evaluation Method>

Particle size distribution: Particle size distribution was measured using a laser-diffraction type of particle-size measuring system by Malvern Instruments.

Sheet gloss: Measured in accordance with JIS P 8142

Printed gloss: The paper was printed on using an offset web press (four-color) by Toshiba Machine and special offset printing ink (Leo Ecoo M by Toyo Ink), with the press operating at a speed of 600 rpm. The surface (solid areas of black, blue and red) of the printed paper was then measured in accordance with JIS P 8142.

Ink-impression property: The paper was printed on using an offset web press (four-color) by Toshiba Machine and special offset printing ink (Leo Ecoo M by Toyo Ink), with the press operating at a speed of 600 rpm. Ink-impression property was then visually evaluated over four levels on the surface (solid area of blue) of the printed paper. The evaluation criteria used were: Excellent (⊙), Good (○), Poor (Δ) and Unacceptable (X).

Opacity: Measured in accordance with JIS P 8138

Density: Measured in accordance with JIS P 8118

Tensile stiffness: Measured using a tensile tester by Lorentzen and Wettre

Printing efficiency: Work efficiency (torn paper, etc.) during offset web printing was evaluated over four levels. The evaluation criteria used were: Excellent (⊙), Good (○), Poor (Δ) and Unacceptable (X).

Example 1

A pigment mixture (volume distribution of particle sizes 0.40 μm to 4.20 μm: 66.6%) consisting of 80 parts of engineered kaoline (ECLIPS650 by Engelhard; volume distribution of particle sizes 0.40 μm to 4.20 μm: 65.3%) and 20 parts of fine-particle ground calcium carbonate (FMT-90 by FIMATEC; volume distribution of particle sizes 0.40 μm to 4.20 μm: 71.9%) was mixed with sodium polyacrylate added as a dispersant to 0.2 part of the pigment, and the mixture was dispersed in a Cellier's mixer to prepare a pigment slurry with a solid content of 70%. The pigment slurry thus obtained was mixed with four parts of hollow plastic pigment with a diameter of 1.0 μm (HP1055 by Rohm and Haans), 10 parts of non-thickening type styrene-butadiene copolymer latex (glass transition point, 15° C.; gel content, 75%) and six parts of hydroxyethyl etherified starch (PG295 by Penford), as well as water, to obtain a coating mixture with a solid content of 60%. The coating mixture was applied to both sides of a wood-containing base paper with a basis weight of 30 g/m$^2$, wherein said base paper consisted of 30 wt-% of mechanical pulp mixed with 4 wt-% of titanium dioxide and 4 wt-% of talc added as fillers (all percentages relative to the weight of the base paper), to a coating weight of 7 g/m$^2$ per side using a blade coater operating at 800 m/min. The coated paper was then dried until the moisture content became 5.5%, after which it was processed via calendering to obtain a coated paper with a tensile stiffness of 375 kN/m.

Example 2

A coated paper was obtained in the same manner as described in Example 1, except that the pigment slurry with a solid content of 70% was obtained by dispersing in a Cellier's mixer a pigment mixture (volume distribution of particle sizes 0.40 μm to 4.20 μm: 68.7%) consisting of 70 parts of Brazilian kaoline (Capim DG by Rio Capim; volume distribution of particle sizes 0.40 μm to 4.20 μm: 68.4%) and 30 parts of coarse-particle ground calcium carbonate (FMT-75 by FIMATEC; volume distribution of particle sizes 0.40 μm to 4.20 μm: 69.5%), to which sodium polyacrylate was added as a dispersant to 0.2 part of the pigment.

Example 3

A coated paper was obtained in the same manner as described in Example 1, except that the coating mixture was applied to both sides of a wood-containing base paper with a basis weight of 35 g/m$^2$, wherein said base paper consisted of 25 wt-% of mechanical pulp as well as 4 wt-% of titanium dioxide and 4 wt-% of talc added as fillers (all percentages relative to the weight of the base paper), to a coating weight of 7 g/m$^2$ per side.

Example 4

A coated paper was obtained in the same manner as described in Example 1, except that the coating mixture was applied to both sides of a wood-containing base paper with a basis weight of 35 g/m$^2$, wherein said base paper consisted of 10 wt-% of mechanical pulp as well as 3 wt-% of titanium dioxide and 3 wt-% of talc added as fillers (all percentages relative to the weight of the base paper), to a coating weight of 7.5 g/m$^2$ per side, whereupon the tensile stiffness of the obtained coated paper was adjusted to 390 kN/m.

Example 5

A coated paper was obtained in the same manner as described in Example 1, except that the coating mixture was applied to both sides of a wood-containing base paper with a basis weight of 35 g/m$^2$, wherein said base paper consisted of 25 wt-% of mechanical pulp as well as 6 wt-% of titanium dioxide and 4 wt-% of talc added as fillers (all percentages relative to the weight of the base paper), to a coating weight of 6.5 g/m$^2$ per side, whereupon the tensile stiffness of the obtained coated paper was adjusted to 290 kN/m.

Example 6

A coated paper was obtained in the same manner as described in Example 1, except that the pigment slurry was prepared without the addition of plastic pigment.

Example 7

A coated paper was obtained in the same manner as described in Example 1, except that the coating mixture was applied to both sides of a wood-containing base paper with a basis weight of 30 g/m$^2$, wherein said base paper consisted of 30 wt-% of mechanical pulp and 4 wt-% of talc added as a filler, to a coating weight of 7 g/m$^2$ per side.

Example 8

A coated paper was obtained in the same manner as described in Example 1, except that the pigment slurry was prepared without the addition of plastic pigment and the coating mixture was applied to both sides of a wood-containing base paper with a basis weight of 30 g/m$^2$, wherein said base paper consisted of 30 wt-% of mechanical pulp and 4 wt-% of talc added as a filler, to a coating weight of 7 g/m$^2$ per side.

Example 9

A coated paper was obtained in the same manner as described in Example 1, except that the pigment slurry was mixed with 4 parts of hollow plastic pigment with a diameter of 1.0 μm, five parts of titanium dioxide, 10 parts of non-thickening styrene-butadiene copolymer latex (glass transition point, 15° C.; gel content, 75%) and 6 parts of hydroxyethyl etherified starch (PG295 by Penford), as well as water, to obtain a coating mixture with a solid content of 60%.

Comparative Example 1

A coated paper was obtained in the same manner as described in Example 1, except that a pigment mixture (volume distribution of particle sizes 0.40 μm to 4.20 μm: 62.5%) consisting of 80 parts of fine clay (MIRASHEEN by Engelhard; volume distribution of particle sizes 0.40 μm to 4.20 μm: 60.2%) and 20 parts of fine-particle ground calcium carbonate (FMT-90 by FIMATEC; volume distribution of particle sizes 0.40 μm to 4.20 μm: 71.9%) was mixed with sodium polyacrylate added as a dispersant to 0.2 part of the pigment, and the mixture was dispersed in a Cellier's mixer to prepare a pigment slurry with a solid content of 70%.

Comparative Example 2

A coated paper was obtained in the same manner as described in Example 1, except that a pigment mixture (volume distribution of particle sizes 0.40 to 4.20 μm: 63.3%) consisting of 60 parts of second-grade clay (DB KOTE by IMERYS; volume distribution of particle sizes 0.40 μm to 4.20 μm: 57.6%) and 40 parts of fine-particle ground calcium carbonate (FMT-90 by FIMATEC; volume distribution of particle sizes 0.40 μm to 4.20 μm: 71.9%) was mixed with sodium polyacrylate added as a dispersant to 0.2 part of the pigment, and the mixture was dispersed in a Cellier's mixer to prepare a pigment slurry with a solid content of 70%.

Comparative Example 3

A coated paper was obtained in the same manner as described in Example 1, except that a pigment mixture (volume distribution of particle sizes 0.40 μm to 4.20 μm: 57.9%) consisting of 25 parts of delaminated clay (DB Plate by IMERYS; volume distribution of particle sizes 0.40 μm to 4.20 μm: 48.1%), 25 parts of #2 clay (DB KOTE by IMERYS; volume distribution of particle sizes 0.40 μm to 4.20 μm: 57.6%), 25 parts of fine clay (AMAZON Plus by CADAM; volume distribution of particle sizes 0.40 μm to 4.20 μm: 53.8%) and 25 parts of fine ground calcium carbonate (FMT-90 by FIMATEC; volume distribution of particle sizes 0.40 μm to 4.20 μm: 71.9%) was mixed with sodium polyacrylate added as a dispersant to 0.2 part of the pigment, and the mixture was dispersed in a Cellier's mixer to prepare a pigment slurry with a solid content of 70%.

Comparative Example 4

A coated paper was obtained in the same manner as described in Example 1, except that the coating mixture was applied to both sides of a medium-grade paper with a basis weight of 32 g/m$^2$, wherein said base paper consisted of 10 wt-% of mechanical pulp as well as 3 wt-% of titanium dioxide and 4 wt-% of talc added as fillers (all percentages relative to the weight of the base paper), to a coating weight of 7 g/m$^2$ per side, whereupon the tensile stiffness of the obtained coated paper was adjusted to 420 kN/m.

The results of the above examples are shown in Table 1.

TABLE 1

| | Volume distribution of particle sizes 0.40 μm to 4.20 μm, % | Plastic pigment content, part(s) | Titanium dioxide content, wt-% | Sheet gloss, % | Printed gloss, % | Opacity, % | Ink-impression property |
|---|---|---|---|---|---|---|---|
| Example 1 | 66.6 | 4 | 2.7 | 45.5 | 59.9 | 87.5 | ◎ |
| Example 2 | 68.7 | 4 | 2.7 | 44.3 | 58.3 | 87.0 | ◎ |

TABLE 1-continued

| | | | | | | | |
|---|---|---|---|---|---|---|---|
| Example 3 | 66.6 | 4 | 2.9 | 45.3 | 58.6 | 88.3 | ◎ |
| Example 4 | 66.6 | 4 | 2.1 | 46.4 | 60.3 | 90.0 | ◎ |
| Example 5 | 66.6 | 4 | 4.4 | 42.8 | 57.3 | 89.1 | ○ |
| Example 6 | 66.6 | 0 | 2.7 | 43.2 | 57.8 | 86.9 | ◎ |
| Example 7 | 66.6 | 4 | 0 | 45.4 | 59.6 | 86.5 | ◎ |
| Example 8 | 66.6 | 0 | 0 | 43.1 | 57.2 | 86.1 | ◎ |
| Example 9 | 66.6 | 4 | 4.0 | 45.2 | 59.0 | 89.2 | ◎ |
| Comparative example 1 | 62.5 | 4 | 2.7 | 47.1 | 54.3 | 87.2 | ◎ |
| Comparative example 2 | 63.3 | 4 | 2.7 | 40.3 | 53.2 | 87.7 | ◎ |
| Comparative example 3 | 57.9 | 4 | 2.7 | 38.5 | 51.3 | 87.3 | ◎ |
| Comparative example 4 | 66.6 | 4 | 2.1 | 45.2 | 59.6 | 87.6 | ◎ |

| | Basis weight, g/m$^2$ | Density, g/cm$^3$ | Tensile stiffness, kN/m | Printability (torn paper) |
|---|---|---|---|---|
| Example 1 | 44 | 1.02 | 375 | ○ |
| Example 2 | 44 | 1.03 | 375 | ○ |
| Example 3 | 49 | 1.01 | 375 | ○ |
| Example 4 | 50 | 1.05 | 390 | ◎ |
| Example 5 | 48 | 1.02 | 290 | ○ |
| Example 6 | 44 | 1.04 | 375 | ○ |
| Example 7 | 44 | 1.05 | 375 | ○ |
| Example 8 | 44 | 1.04 | 375 | ○ |
| Example 9 | 44 | 1.03 | 375 | ○ |
| Comparative example 1 | 44 | 1.05 | 375 | ○ |
| Comparative example 2 | 44 | 1.03 | 375 | ○ |
| Comparative example 3 | 44 | 1.02 | 375 | ○ |
| Comparative example 4 | 46 | 1.05 | 420 | X |

The present invention allows for the production of a coated paper for printing that is light in weight yet offers opacity suitable for actual use, possessing a relatively good ink-impression property and high printed gloss, and particularly an excellent printability that prevents the paper from tearing during offset web printing.

What is claimed is:

1. A coated paper for offset printing which comprises a base paper and a coating layer containing a pigment and an adhesive, wherein said coating layer has a volume distribution of 65% or more of pigment particles ranging from 0.4 μm to 4.2 μm in size, and wherein said coated paper has a basis weight of 48 g/m$^2$ or less and tensile stiffness ranging from 200 kN/m to 400 kN/m.

2. The coated paper for printing as described in claim 1, wherein said paper contains from 1 to 20 weight-parts of hollow plastic pigment with a diameter of 0.8 μm or more relative to 100 weight-parts of pigment.

3. The coated paper for printing as described in claim 2, further comprising 0.5 to 12 wt-% of titanium dioxide relative to the weight of said paper.

4. The coated paper for printing as described in claim 1, further comprising 0.5 to 12 wt-% of titanium dioxide relative to the weight of said paper.

* * * * *